US010371139B2

(12) United States Patent
Shibata

(10) Patent No.: US 10,371,139 B2
(45) Date of Patent: Aug. 6, 2019

(54) HYDRAULIC PRESSURE CONTROL DEVICE

(71) Applicant: OKUMA Corporation, Niwa-gun, Aichi (JP)

(72) Inventor: Tomohiro Shibata, Aichi (JP)

(73) Assignee: OKUMA CORPORATION, Aichi (JP)

( * ) Notice: Subject to any disclaimer, the term of this patent is extended or adjusted under 35 U.S.C. 154(b) by 563 days.

(21) Appl. No.: 14/861,352

(22) Filed: Sep. 22, 2015

(65) Prior Publication Data

US 2016/0084724 A1 Mar. 24, 2016

(30) Foreign Application Priority Data

Sep. 22, 2014 (JP) ..... 2014-192969

(51) Int. Cl.
*F04B 49/06* (2006.01)
*F04B 49/08* (2006.01)
(Continued)

(52) U.S. Cl.
CPC ..... *F04B 49/103* (2013.01); *F04B 49/065* (2013.01); *F04B 49/08* (2013.01);
(Continued)

(58) Field of Classification Search
CPC ..... F04B 49/08; F04B 49/065; F04B 49/103; F04B 2201/1202; F04B 2201/1201; F04B 2205/06; F04B 2207/01
See application file for complete search history.

(56) References Cited

U.S. PATENT DOCUMENTS 5,944,492 A * 8/1999 Konishi ..... E02F 9/2235 417/222.1
8,303,260 B2 * 11/2012 Stavale ..... F04D 15/0088 417/20
(Continued)

FOREIGN PATENT DOCUMENTS

CN 101021730 A 8/2007
CN 101360917 A1 2/2009
(Continued)

OTHER PUBLICATIONS

Wikipedia, "Filter (Signal Processing)", 2013.*
(Continued)

*Primary Examiner* — Christopher S Bobish
(74) *Attorney, Agent, or Firm* — Cantor Colburn LLP

(57) ABSTRACT

A hydraulic pressure control device comprising: a hydraulic sensor provided between a hydraulic pump and a load; a speed command arithmetic unit configured to output a speed command value Vc based on a difference between a hydraulic pressure detection value Pd from the hydraulic sensor and a hydraulic pressure command value Pc; a torque command value arithmetic unit configured to calculate a torque command value Tc based on a difference between a speed detection value Vd of a motor and the speed command value Vc; a current controller configured to control current of the motor based on the torque command value Tc; and a hydraulic pressure abnormality detector configured to detect whether a hydraulic circuit has abnormality based on the speed command value Vc and an operating condition of the load of the hydraulic circuit commanded from an upper-level control device.

2 Claims, 2 Drawing Sheets

(51) Int. Cl.
*F04B 49/10* (2006.01)
*F04B 51/00* (2006.01)

(52) U.S. Cl.
CPC ..... *F04B 51/00* (2013.01); *F04B 2201/1201* (2013.01); *F04B 2201/1202* (2013.01); *F04B 2205/06* (2013.01); *F04B 2207/01* (2013.01)

(56) References Cited

U.S. PATENT DOCUMENTS

| | | | | |
|---|---|---|---|---|
| 8,393,852 | B2 * | 3/2013 | Kaufmann | F02B 39/16 415/1 |
| 9,091,259 | B2 * | 7/2015 | Tamminen | F04B 49/00 |
| 2007/0194740 | A1 | 8/2007 | Shibata et al. | |
| 2009/0097986 | A1 | 4/2009 | Nakata et al. | |

FOREIGN PATENT DOCUMENTS

| | | | |
|---|---|---|---|
| JP | 07252037 | A | 10/1995 |
| JP | H09074781 | A | 3/1997 |
| JP | 2005195081 | A | 7/2005 |
| JP | 2014110704 | A | 6/2014 |

OTHER PUBLICATIONS

SIPO First Office Action corresponding to Application No. 201510599093.9; dated Nov. 3, 2017.
Notice of Grounds for Rejection for corresponding JP Application No. 2014-192969; dated Jan. 30, 2018.
SIPO Second Office Action corresponding to Application No. 201510599093.9; dated Jul. 4, 2018.

* cited by examiner

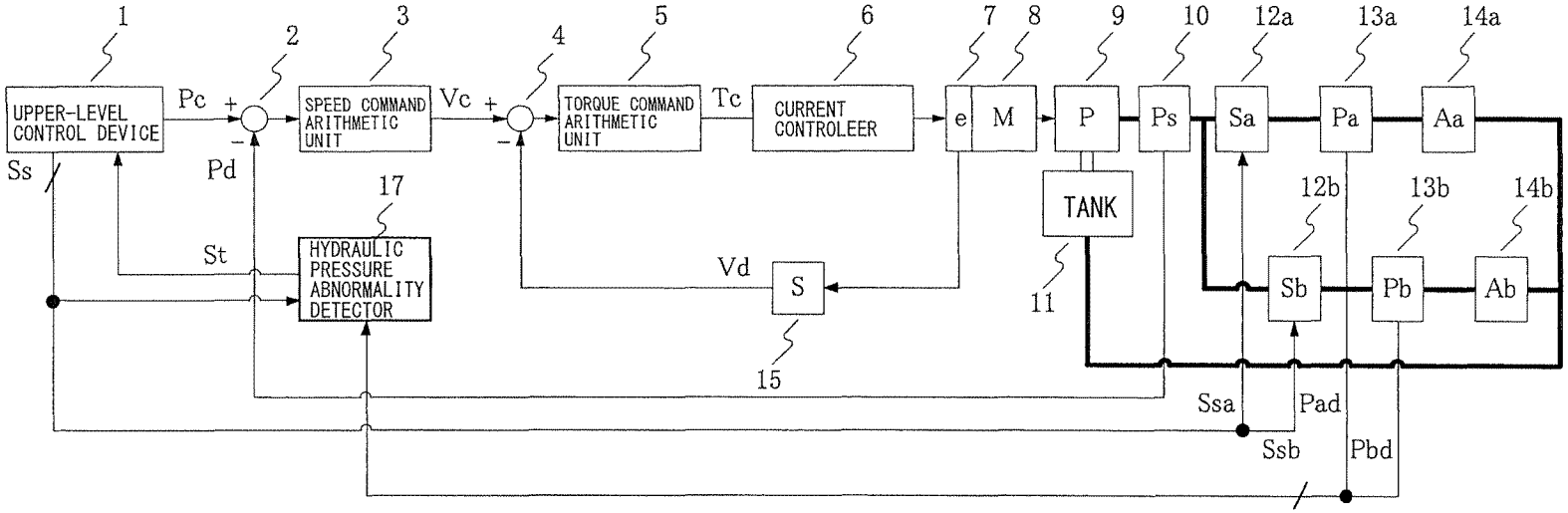
PRIOR ART FIG. 4
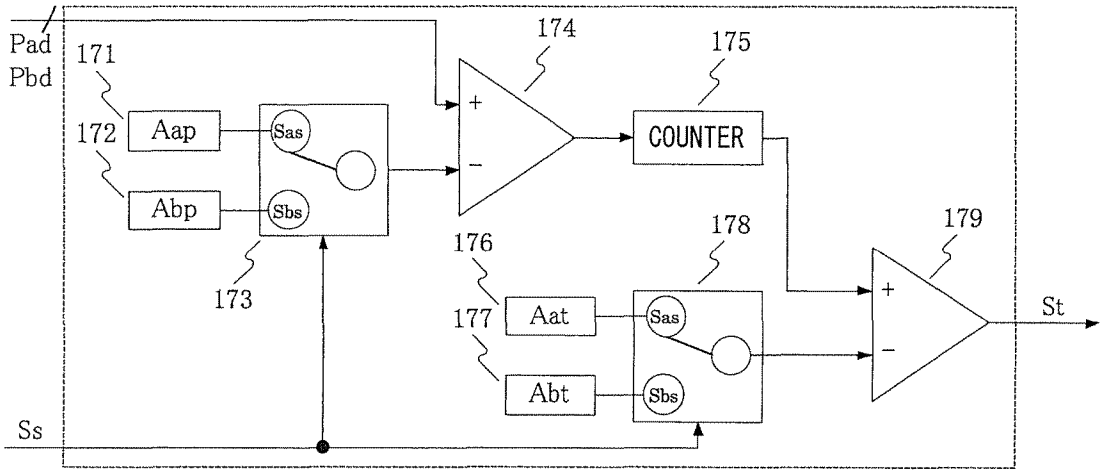
PRIOR ART FIG. 5

HYDRAULIC PRESSURE CONTROL DEVICE

PRIORITY INFORMATION

The present invention claims priority under 35 U.S.C. § 119 to Japanese Application No. 2014-192969 filed on Sep. 22, 2014, the entire content of which is incorporated herein by reference.

BACKGROUND

Technical Field

The invention relates to control for a motor that drives a hydraulic pump in a hydraulic unit for a machining tool.

Related Art

In a hydraulic unit, a motor is coupled to a hydraulic pump, and the motor is rotated under feedback control based on a detection value from a hydraulic sensor and the like, whereby a hydraulic pressure is provided. Since such a hydraulic unit is provided with a hydraulic sensor and the like, various attempts are being made to detect abnormality of a hydraulic circuit based on detection values from the hydraulic sensor and the like.

FIG. 4 illustrates a block diagram of a motor control device that drives a hydraulic pump of a conventional technique. A hydraulic circuit includes a hydraulic pump 9 and selector switches 12*a* and 12*b* that switch the hydraulic circuit based on a switching command Ss from an upper-level control device 1 such as solenoids. The hydraulic circuit operates actuators 14*a* and 14*b* such as hydraulic cylinders. In the hydraulic circuit, a hydraulic pressure detection value Pd of a hydraulic sensor 10 provided between the hydraulic pump 9 and the selector switches 12*a* and 12*b* is fed back. Then, a deviation between a hydraulic pressure command value Pc output from the upper-level control device 1 and the hydraulic pressure detection value Pd is calculated as a hydraulic deviation by a subtractor 2. A speed command arithmetic unit 3 outputs a speed command value Vc through proportional-integral control based on the hydraulic deviation.

In order to rotate the hydraulic pump 9, a motor 8 is coupled to the hydraulic pump 9, and a motor position detector 7 is attached to the motor 8. A differentiator 15 differentiates a position detection value detected by the motor position detector 7 to output a speed detection value Vd of the motor. Then, a subtractor 4 calculates a deviation between the speed command value Vc and the speed detection value Vd of the motor and outputs the deviation as a speed deviation. Based on the speed deviation, a torque command arithmetic unit 5 outputs a torque command Tc through proportional-integral control. Based on the torque command Tc, a current controller 6 including an inverter causes current to flow to the motor to control the motor. In addition, a hydraulic pressure abnormality detector 17 detects that hydraulic pressure is abnormal based on hydraulic pressure detection values Pad and Pbd detected by the hydraulic sensors 13*a* and 13*b* provided between the selector switches 12*a* and 12*b* and the actuators 14*a* and 14*b*, and the switching command Ss, and reports the abnormality to the upper-level control device.

FIG. 5 illustrates a specific block diagram of the hydraulic pressure abnormality detector. The hydraulic pressure abnormality detector compares the hydraulic pressure detection values Pad and Pbd and a hydraulic pressure threshold for abnormality detection Aap or a hydraulic pressure threshold abnormality detection Abp that is selected by a selector 173 based on the switching command Ss and using a comparator 174. Based on the comparison result, a counter 175 detects a hydraulic pressure drop time. The hydraulic pressure drop time and is compared with a time threshold for abnormality detection Aat or a time threshold for abnormality detection Abt selected by a selector 178 based on the switching command Ss, by a comparator 179. When the actuator 14*a* is operated in a state where a leakage amount is large due to some abnormality of the actuator 14*a*, a time period until the hydraulic pressure detection value Pad drops becomes long. As a result, the hydraulic pressure drop time detected by the counter becomes long. When the hydraulic pressure drop time becomes longer than the time for abnormality detection Aat, the threshold comparator 179 detects abnormality, reports the abnormality to the upper-level control device, and reports to an operator that the hydraulic circuit or the actuator is abnormal.

The conventional technique illustrated in FIG. 4 has a problem that abnormality cannot be found upon failure of the hydraulic pump or occurrence of leakage from a passage from the pump to the selector switch in the hydraulic circuit. In addition, many hydraulic sensors are needed, causing an increase in cost, which can be a problem.

SUMMARY OF THE INVENTION

The present invention is made in view of the above problems and provides a hydraulic pressure control device configured to provide a hydraulic pressure by a motor that rotates a hydraulic pump, the hydraulic pressure control device including: a hydraulic sensor provided between the hydraulic pump and at least one load; a speed command arithmetic unit configured to output a speed command value based on a difference between a hydraulic pressure detection value from the hydraulic sensor and a hydraulic pressure command value; a torque command value arithmetic unit configured to calculate a torque command value based on a difference between a speed detection value of the motor and the speed command value; a current control unit configured to control current of the motor based on the torque command; and a hydraulic pressure abnormality detector configured to detect whether a hydraulic circuit has abnormality based on the speed command value or a value obtained by performing primary delay filter processing on the speed command value and an operating condition of the load of the hydraulic circuit commanded from an upper-level control device.

According to the hydraulic pressure control device according to the present invention, failure not only of an actuator but also of the hydraulic pump and abnormality of the whole hydraulic circuit including a passage from the hydraulic pump to a selector switch can be detected without increasing the number of the hydraulic sensors and thus inexpensively.

BRIEF DESCRIPTION OF DRAWINGS

Preferred embodiments of the present invention will be described in detail with reference to the following figures, wherein:

FIG. 4 is a block diagram illustrating a conventional technique; and

FIG. 5 is a block diagram illustrating a hydraulic pressure abnormality detector according to the conventional technique.

DETAILED DESCRIPTION

Figure 1:
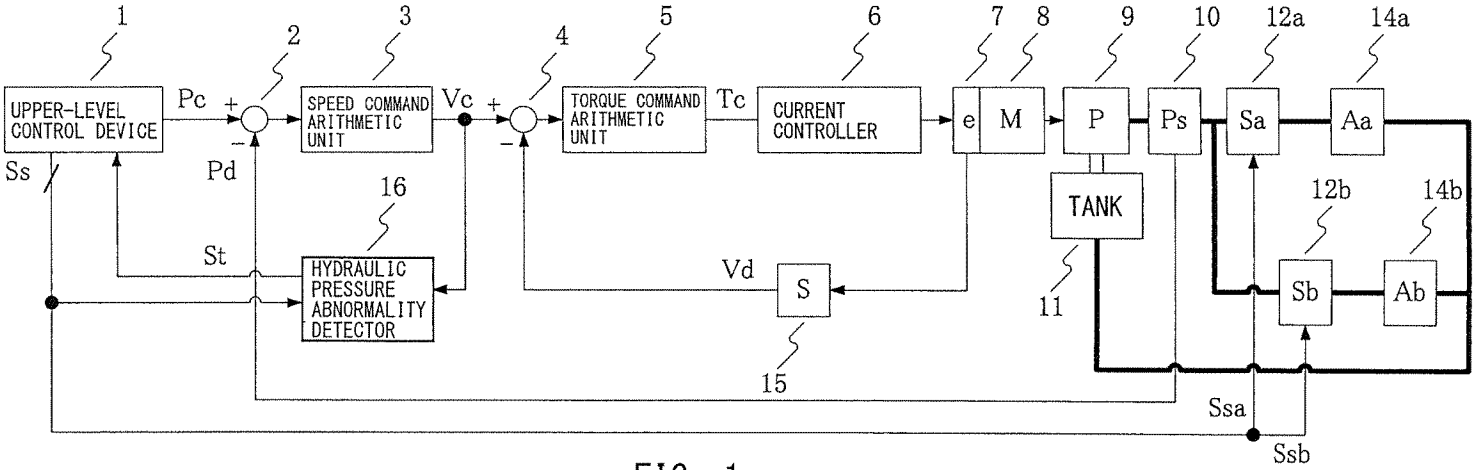
FIG. 1 is a block diagram illustrating an embodiment of the present invention.

An embodiment of the present invention will be described. Elements that are similar to those of the conventional example are denoted by similar reference signs and redundant description thereof will be avoided. FIG. 1 illustrates a block diagram of a hydraulic control device of the present invention. A hydraulic pressure abnormality detector 16 detects that the hydraulic pressure is abnormal based on the switching command Ss and the speed command value Vc and reports to the upper-level control device that the hydraulic pressure is abnormal.

Figure 2:
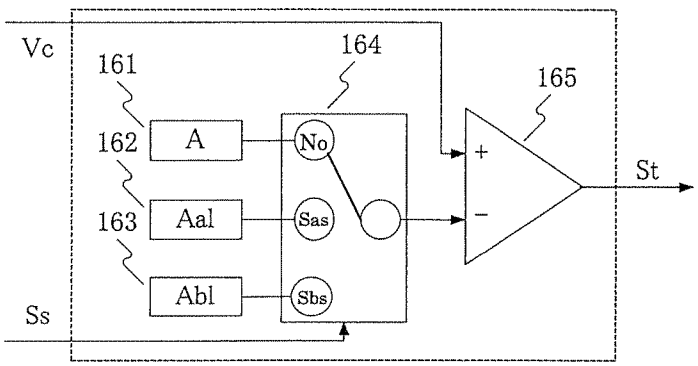
FIG. 2 is a block diagram illustrating a hydraulic pressure abnormality detector according to the embodiment of the present invention.

FIG. 2 illustrates a block diagram of a specific hydraulic pressure abnormality detector of the present invention. Based on the switching command Ss, a selector 164 selects one of abnormal flow rate thresholds 161, 162, and 163. A comparator 165 compares the speed command value Vc and the selected abnormal flow rate threshold 161, 162, or 163, and reports to the upper-level control device that the hydraulic pressure is abnormal when the speed command value Vc is larger than the abnormal flow rate threshold.

Specifically, the flow rate is substantially identical to the speed command value. In addition, a flow rate required upon actuation of the actuator; that is, the speed command value, can be measured in advance. Therefore, when the actuator 14*a* is operated in a state where a leakage amount is large due to some abnormality, the motor is operated such that the hydraulic pressure detection value Pd becomes a desired value. Thus, the speed command value becomes large. When a selector switch Sa is operated based on the switching command Ss from the selector 164, a value Aal for an actuator Aa is selected as an abnormal flow rate threshold. When the speed command value exceeds the abnormal flow rate threshold Aal, the comparator 165 reports the abnormality to the upper-level control device. When a selector switch Sb is operated based on the switching command Ss from the selector 164, a value Abl for an actuator Ab is selected as an abnormal flow rate threshold. When the speed command value exceeds the abnormal flow rate threshold Abl, the comparator 165 reports the abnormality to the upper-level control device. In addition, when no selector switch is turned on, the selector 164 selects a value A for a case where no actuator is operated as an abnormal flow rate threshold based on the switching command Ss. Thus, the comparator 165 reports the abnormality to the upper-level control device when the speed command value exceeds the abnormal flow rate threshold A even upon failure of the hydraulic pump or large leakage of the hydraulic circuit. Setting of the abnormal flow rate threshold A to a value, which is slightly larger than the value for a case where no actuator is operated, enables more strict check of the hydraulic circuit condition. In addition, report to the upper-level control device in the state becomes possible, thereby enabling preventive maintenance.

Figure 3:
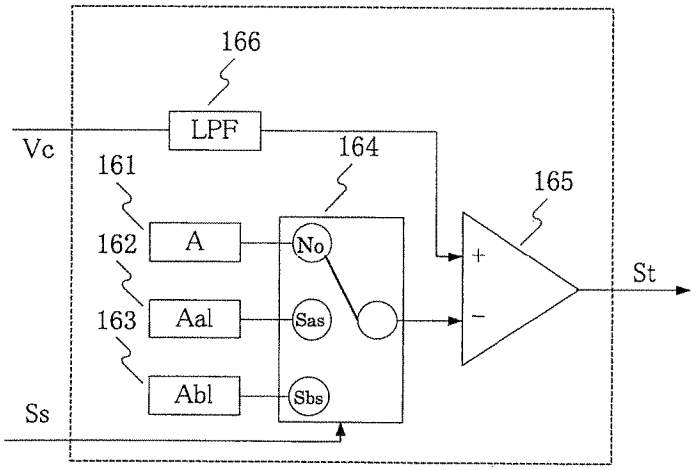
FIG. 3 is a block diagram illustrating a hydraulic pressure abnormality detector according to an embodiment of the present invention.

FIG. 3 illustrates another block diagram of a hydraulic pressure abnormality detector of the present invention. Elements that are similar to those of the conventional example are denoted by similar reference signs and redundant description thereof will be avoided. The comparator 165 compares a filter-processed speed command value, which is a speed command value after filter processing by a low pass filter 166, and an abnormal flow rate threshold, and reports the abnormality to the upper-level control device when the speed command value Vc is larger than the abnormal flow rate threshold.

Specifically, a speed detector vibrates at some amplitude due to sudden change of hydraulic pressure upon actuation of the actuators, ripple caused by the hydraulic pump during steady operation, and the like. With this vibration, the speed command value Vc also vibrates, and thus a large value should be set to the abnormal flow rate threshold so as not to detect abnormality with excessive sensitivity. In such a case, an abnormality of the hydraulic circuit can be detected more strictly and precisely by using the filter-processed speed command value as a determination value.

What is claimed is:

1. A hydraulic pressure control device configured to provide a hydraulic pressure by a motor that rotates a hydraulic pump, the hydraulic pressure control device comprising:

a hydraulic pump and a motor;

a single hydraulic sensor, wherein the hydraulic sensor is provided between the hydraulic pump and at least one load in a hydraulic circuit;

a speed command arithmetic unit configured to output a speed command value based on a difference between a hydraulic pressure detection value from the hydraulic sensor and a hydraulic pressure command value;

a torque command value arithmetic unit configured to calculate a torque command value based on a difference between a speed detection value of the motor and the speed command value;

a current controller configured to control current of the motor based on the torque command value; and a hydraulic pressure abnormality detector configured to detect whether the hydraulic circuit has abnormality based on the speed command value and an operating condition of the at least one load of the hydraulic circuit commanded from an upper-level control device, wherein the at least one load includes a plurality of loads and the plurality of loads are connected to the hydraulic pump in parallel, between the hydraulic pump and each of the loads, there is provided a respective selector switch configured to switch the loads connected to the hydraulic pump, and the single hydraulic sensor is provided between the hydraulic pump and the respective selector switches, there is no hydraulic sensor between the selector switches and the loads, the hydraulic pressure abnormality detector includes a selector that holds a threshold value which is selected when all of the selector switches are switched OFF and a threshold value which is set for each selector switch, and that outputs one of the threshold values corresponding to ON-OFF states of the selector switches, and the hydraulic pressure abnormality detector determines that an abnormality has occurred when the speed command value exceeds the threshold value which is output from the selector.

2. The hydraulic control device according to claim 1, wherein the hydraulic pressure abnormality detector performs primary delay filter processing on the speed command value.

* * * * *